US010683615B2

(12) United States Patent
Monacelli et al.

(10) Patent No.: US 10,683,615 B2
(45) Date of Patent: Jun. 16, 2020

(54) PAPER MATERIAL AND RELATIVE MANUFACTURING PROCEDURE

(71) Applicant: Gruppo Cordenons S.p.A., Milan (IT)

(72) Inventors: Luca Monacelli, Cordenons (IT); Ferruccio Beniamino Gilberti, Milan (IT)

(73) Assignee: Gruppo Cordenons, S.P.A., Milan (IT)

( * ) Notice: Subject to any disclaimer, the term of this patent is extended or adjusted under 35 U.S.C. 154(b) by 259 days.

(21) Appl. No.: 15/521,963

(22) PCT Filed: Oct. 27, 2015

(86) PCT No.: PCT/EP2015/074799

§ 371 (c)(1),
(2) Date: Apr. 26, 2017

(87) PCT Pub. No.: WO2016/066606

PCT Pub. Date: May 6, 2016

(65) Prior Publication Data

US 2017/0314202 A1 Nov. 2, 2017

(30) Foreign Application Priority Data

Oct. 27, 2014 (IT) ..... MI2014A1842

(51) Int. Cl.

| | |
|---|---|
| ***D21H 13/34*** | (2006.01) |
| ***D21H 17/28*** | (2006.01) |
| ***D21H 21/18*** | (2006.01) |
| ***D21H 17/22*** | (2006.01) |
| ***D21H 21/14*** | (2006.01) |
| ***D21H 17/35*** | (2006.01) |
| ***D21H 17/37*** | (2006.01) |
| ***D21H 17/57*** | (2006.01) |
| ***D21H 17/67*** | (2006.01) |
| ***D21H 17/68*** | (2006.01) |

(52) U.S. Cl.

CPC ..... *D21H 13/34* (2013.01); *D21H 17/22* (2013.01); *D21H 17/28* (2013.01); *D21H 17/35* (2013.01); *D21H 17/37* (2013.01); *D21H 17/57* (2013.01); *D21H 17/675* (2013.01); *D21H 17/68* (2013.01); *D21H 21/14* (2013.01); *D21H 21/18* (2013.01)

(58) Field of Classification Search

CPC ..... D21H 13/34; D21H 13/02

USPC ..... 428/323

See application file for complete search history.

(56) References Cited

U.S. PATENT DOCUMENTS

| | | | | |
|---|---|---|---|---|
| 2,064,387 A | | 12/1936 | Schwartz | |
| 3,242,028 A | | 3/1966 | Hart | |
| 4,162,996 A | * | 7/1979 | Parrini | D06N 3/0002 524/11 |
| 4,983,257 A | | 1/1991 | Schultz | |
| 2003/0087982 A1 | * | 5/2003 | Kanazawa | C08J 7/047 522/49 |

FOREIGN PATENT DOCUMENTS

| | | | | |
|---|---|---|---|---|
| EP | 0259671 A1 | | 3/1988 | |
| EP | 1431457 A1 | | 6/2004 | |
| EP | 2636792 A1 | | 9/2013 | |
| JP | 11322962 A | * | 11/1999 | D21H 13/20 |
| JP | 2011052362 A | | 3/2011 | |

OTHER PUBLICATIONS

English abstract of JP 11322962 A, to Sakamoto, published Nov. 1999 (Year: 1999).*

Machine translation JP 11322962 A, to Sakamoto, published Nov. 1999 (Year: 1999).*

International Search Report dated Dec. 23, 2015; International Application No. PCT/EP2015/074799; International Filing Date: Oct. 27, 2015; 4 pages.

English translation; European Publication No. EP0259671; Published Mar. 16, 1988; 19 pages.

Written Opinion dated Dec. 23, 2015; International Application No. PCT/EP2015/074799; International Filing Date: Oct. 27, 2015; 6 pages.

English translation; Japanese Publication No. 2011052362; Published Mar. 17, 2011; 27 pages.

* cited by examiner

*Primary Examiner* — Jane L Stanley

(74) *Attorney, Agent, or Firm* — Blank Rome LLP

(57) ABSTRACT

The paper material comprises a support base having at least one surface treated with at least one surface adhesive giving the paper material printability characteristics, the support base containing a mixture of fibres, at least one polymeric substance, adapted to give the support base strength, and at least one inorganic filler, adapted to give the support base machinability characteristics, the mixture of fibres comprising cellulose fibres and animal milk protein fibres.

12 Claims, No Drawings

PAPER MATERIAL AND RELATIVE MANUFACTURING PROCEDURE

The present invention refers to a paper material (paper/cardboard) containing fibres obtained industrially from animal milk proteins and to the relative manufacturing procedure; more precisely, owing to a specially devised pulp and a specific surface treatment, the paper material of the invention creates a particular smooth and velvet-like effect accompanied by a particular scent of milk.

In the paper sector, there is a constant search for new types of paper having particular characteristics and finishes, especially papers designed for packing, packaging, realizing illustrative material, quality printing, et cetera.

However, it is not uncommon that the achievement of special effects is detrimental to other characteristics of the paper, such as printability.

An aim of the present invention is to provide a paper material that has a set of tactile and fragrant effects differing from conventional paper materials, while also being printable with high printing quality.

Therefore, the present invention refers to a paper material comprising a support base having at least one surface treated with at least one surface adhesive, said support base containing a mixture of fibres, at least one polymeric substance, adapted to give the support base strength, and at least one inorganic filler, adapted to give the support base machinability characteristics, characterized in that said mixture of fibres comprises cellulose fibres and animal milk protein fibres, said fibres from animal milk proteins being present in the support base up to a 50% maximum content by weight.

The present invention also relates to a method for manufacturing the paper material, comprising the steps of:

(a) preparing an aqueous pulp comprising a mixture of fibres containing at least cellulose fibres and animal milk protein fibres, at least one polymeric substance and at least one inorganic filler;

(b) removing water from the pulp so as to form a support base of the paper material having animal milk protein fibres in a maximum percentage of 50% by weight;

(c) treating at least one surface of the support base with at least one surface adhesive.

Milk protein fibres included in the paper material of the present invention are treated with an anti-dissolving agent of a type known in the art.

Preferred embodiments of the paper material and the relative manufacturing procedure are defined in the dependent claims.

The invention thus provides a paper material (paper/cardboard) that is velvet-like, soft and milk-scented, owing to a specially devised pulp and a specific surface treatment, and also owing to a production method that makes it possible to mix the fibres obtained from animal milk proteins with conventional paper pulps.

In a preferred embodiment of the invention, the animal milk proteins comprise at least casein.

In a preferred embodiment of the invention, the animal milk proteins are derived from the milk of ruminant artiodactyls.

In particular, the animal milk protein fibres are derived from sheep or bovids, among which cows, goats and yaks.

The paper material of the invention proves to be perfectly printable with high printing quality and makes it possible to achieve particular graphic effects that are difficult to achieve with conventional natural papers.

In further detail, the paper material of the invention comprises a support base made up of a mixture of cellulosic fibres and animal milk protein fibres of varying percentages and it contains at least one polymeric substance, adapted to give the mixture of fibres strength (when dry or wet), and at least one inorganic filler, adapted to give the material good machinability characteristics.

Preferably, the polymeric substance included in the support base comprises one or more colophony-based and/or alkyl-ketene-dimer-based and/or acetylsuccinic-acid-based and/or epochlorohydrin-based resins, and/or modified starches.

The inorganic filler is instead a mineral filler comprising one or more substances selected from the group constituted by carbonates, kaolins, talc and mixtures thereof.

The surface adhesive is for example an adhesive based on starch and/or polyvinyl alcohol and/or acrylic, polyurethane and/or styrene-butadiene polymers.

The grammage of the paper material ranges between approximately 70 and approximately 400 g/m$^2$.

In accordance with a further aspect of the present invention, the paper material described hereinabove is realized using the following method.

It is realized using a substantially known paper-forming technique, for example on a continuous machine for manufacturing paper.

In essence, an aqueous pulp comprising a mixture of cellulose fibres and animal milk protein fibres, the polymeric substance (colophony-based and/or alkyl-ketene-dimer-based and/or acetylsuccinic-acid-based and/or epochlorohydrin-based resins, and/or modified starches) and the inorganic filler (carbonates, kaolins, talc, et cetera) is prepared.

Water is then removed from the pulp so as to form the support base of the paper material having animal milk protein fibres in a percentage varying up to 50% by weight.

This is followed by a step of surface treatment of one or both faces of the support base with an aqueous solution of surface adhesive, for example made up of a 10% by weight aqueous solution of starch, and/or 5% by weight of acrylic adhesive, or similar adhesives.

Following the surface treatment with the adhesive, the method then comprises a step of smoothing the paper and in which the paper base is smoothed up to Bendtsen ISO 2494 roughness values of less than approximately 50 ml/min. Lastly, the method can comprise a step of mechanically treating the surface, particularly an embossing step.

Example of a Pulp Containing Animal Milk Protein Fibres for Forming the Support Base

- 20% by dry weight of animal milk protein fibres
- 60% by dry weight of cellulosic fibres of various origin and types
- 10% by dry weight of inorganic filler such as carbonate or kaolin
- 1% by dry weight of a polymeric substance based on potato starch and/or cornflour
- 1% by dry weight of a polymeric substance based on colophony, AKD or ASA
- 1% by dry weight of a polymeric substance based on acrylic ester, styrene, acrylonitrile
- 1% by dry weight of a polyurethane-based polymeric substance
- 6% by weight, water It remains understood that modifications and variants that are not beyond the scope of the invention as defined in the appended claims, may be made concerning the paper material and the relative manufacturing method disclosed and illustrated herein.

The invention claimed is:

1. A paper material comprising a support base having at least one surface treated with at least one surface adhesive, said support base containing a mixture of fibers, at least one polymeric substance, adapted to give the support base strength, and at least one inorganic filler, adapted to give the support base machinability characteristics, wherein said mixture of fibers comprises cellulose fibers and animal milk protein fibers, said animal milk protein comprising whey and casein, said fibers from animal milk proteins representing up to a 50% maximum content by weight of the mixture of fibers.

2. The paper material according to claim 1, wherein said animal milk proteins are derived from the milk of ruminant artiodactyls.

3. The paper material according to claim 1, wherein the at least one polymeric substance included in the support base comprises one or more colophony-based and/or alkyl-ketene-dimer-based and/or acetyl succinic-acid-based and/or epichlorohydrin-based resins, and/or modified starches.

4. The paper material according to claim 1, wherein the inorganic filler is a mineral filler and comprises one or more substances selected from the group constituted by carbonates, kaolins, talc and mixtures thereof.

5. The paper material according to claim 1, wherein the at least one surface adhesive is an adhesive based on starch and/or polyvinyl alcohol and/or acrylic and/or polyurethane and/or styrene-butadiene polymers.

6. A method for manufacturing paper material, the method comprising the steps of:

(a) preparing an aqueous pulp comprising a mixture of fibers containing at least cellulose fibers and animal milk protein fibers, at least one polymeric substance and at least one inorganic filler, where said animal milk protein comprises whey and casein;

(b) removing water from the pulp so as to form a support base of the paper material having animal milk protein fibers in a maximum percentage of 50% by weight of the mixture of fibers; and (c) treating at least one surface of the support base with at least one surface adhesives wherein the at least one polymeric substance is adapted to give the support base strength and the at least one inorganic filler is adapted to give the support base machinability characteristics.

7. The method according to claim 6, wherein said animal milk proteins are derived from the milk of ruminant artiodactyls.

8. The method according to claim 6, wherein the at least one polymeric substance included in the support base comprises one or more colophony-based and/or alkyl-ketene-dimer-based and/or acetylsuccinic-acid-based and/or epichlorohydrin-based resins, and/or modified starches.

9. The method according to claim 6, wherein the inorganic filler is a mineral filler and comprises one or more substances selected from the group constituted by carbonates, kaolins, talc and mixtures thereof.

10. The method according to claim 6, wherein the at least one surface adhesive is an adhesive based on starch and/or polyvinyl alcohol and/or acrylic and/or polyurethane and/or styrene-butadiene polymers.

11. The method according to claim 6, wherein following treatment of the surface with the adhesive, further comprises a step of smoothing the support base, wherein the support base is smoothed up to Bendtsen ISO 2494 roughness values of less than approximately 50 ml/min.

12. The method according to claim 6, further comprising a step of mechanically treating the surface, particularly an embossing step.

* * * * *